United States Patent [19]

Stader

[11] 4,343,475

[45] Aug. 10, 1982

[54] EARTHQUAKE GAME DEVICE

[76] Inventor: Irvin S. Stader, 3783 Alma Dr., Memphis, Tenn. 38127

[21] Appl. No.: 233,439

[22] Filed: Feb. 11, 1981

[51] Int. Cl.[3] ..... A63F 3/00

[52] U.S. Cl. ..... 273/276; 46/1 C; 46/31; 273/1 GF; 273/157 R; 434/299

[58] Field of Search ..... 273/276, 1 G, 1 GF, 273/157 R; 46/1 C, 26, 31; 434/299

[56] References Cited

U.S. PATENT DOCUMENTS

| | | | |
|---|---|---|---|
| 604,708 | 5/1898 | Burton | 46/26 |
| 2,341,757 | 2/1944 | Brenneman et al. | 46/26 X |
| 2,417,641 | 3/1947 | Fischer | 273/1 G X |
| 3,137,967 | 6/1964 | Fliet | 273/157 R X |
| 4,135,715 | 1/1979 | Soulos | 273/1 GF |

*Primary Examiner*—Anton O. Oechsle
*Attorney, Agent, or Firm*—Harvey B. Jacobson

[57] ABSTRACT

A game device including a generally horizontally disposed building board of wood or other rigid material having a hole in one portion of the surface thereof which communicates with a downwardly inclined tubular member in the form of a tunnel having transverse ridges in the lower surface thereof. A plurality of building blocks of wood or other material are provided in order to construct a toy block building on the building board and heavy metal balls are provided for rolling movement through the tube or tunnel with engagement of the heavy ball with the ridges causing the building board to shake and also to produce a noise to simulate the conditions which exist during an earthquake. The blocks are optionally interconnected by pins to produce an earthquake-proof building, a spinner is provided to control operation of the game and picture puzzles are provided on opposite sides of the building blocks, thus enabling multiple games to be played.

6 Claims, 7 Drawing Figures

ADD 7 WITH PIN
ADD 5 WITH PIN
EARTH-QUAKE 7
ADD 7 WITH OUT PIN
ADD 5 WITH OUT PIN
EARTH-QUAKE 5
ERROR BLDG. 7
ERROR BLDG. 5
ADD 5 WITH PIN
EARTH-QUAKE 5

EARTHQUAKE GAME DEVICE

BACKGROUND OF THE INVENTION

1. Field of the Invention

The present invention generally relates to a game device and more specifically one in which a building board is provided on which a building is constructed from toy blocks and a downwardly extending tunnel with ridges in the bottom thereof which receives a heavy ball which rolls through the tunnel due to gravity and causes noise and vibration of the building board simulative of an earthquake, with the playing of the game being controlled by a spinner and the building blocks include connecting pins to render the building constructed from the blocks more earthquake-proof and also provided with picture puzzles on opposite sides thereof to enable puzzle-type games to be played.

2. Description of the Prior Art

Various types of game devices have been provided in which structures are assembled by using building blocks, or the like, controlled by chance devices, and the like. The following U.S. patents are those known relevant to this field of endeavor.

U.S. Pat. Nos. 2,456,098—Dec. 14, 1948—Wheeler; 2,506,184—May 2, 1950—Twining; 2,620,192—Dec. 2, 1952—Housley; 3,452,989—July 1, 1969—Jernstrom; 3,633,915—Jan. 11, 1972—Lippert; and 4,133,538—Jan. 9, 1979—Ambrose.

None of the above-listed patents disclose any structure which relates to the simulation of an earthquake, the construction of an earthquake-proof building or a multiple use game which includes picture puzzles as well as being simulative of earthquake conditions.

SUMMARY OF THE INVENTION

An object of the present invention is to provide a game device capable of being used in playing several different games including a game simulative of earthquake conditions and picture puzzle games.

Another object of the invention is to provide a game device including a building board, building blocks and a tunnel connected with the building board through which a heavy rigid ball can be rolled with ridges in the tunnel creating noise and vibrating conditions on the building board to simulate earthquake conditions so that a structure constructed from building blocks will either be destroyed by the vibrations or withstand the vibrations and remain intact.

A further object of the game device is to provide a control spinner for controlling operation of the game and use of connecting pins for the building blocks to render structures made by the building blocks more earthquake-proof.

Still another object of the invention is to provide a game device in accordance with the preceding objects in which the building blocks are provided with segments of picture puzzles on opposite sides thereof to enable picture puzzle games to be played with the game device.

Still another important feature of the present invention is the provision of a game device which is relatively simple in construction, easy to use, adapted to develop hand and eye coordination of young players, help young players to learn about scientific terms and measurements associated with earthquakes and give young players confidence in themselves and in the ability of humanity to overcome and live with the natural elements of the earth.

These together with other objects and advantages which will become subsequently apparent reside in the details of construction and operation as more fully hereinafter described and claimed, reference being had to the accompanying drawings forming a part thereof, wherein like numerals refer to like parts throughout.

DESCRIPTION OF THE PREFERRED EMBODIMENT

Figures 1, 4, 5, 6:
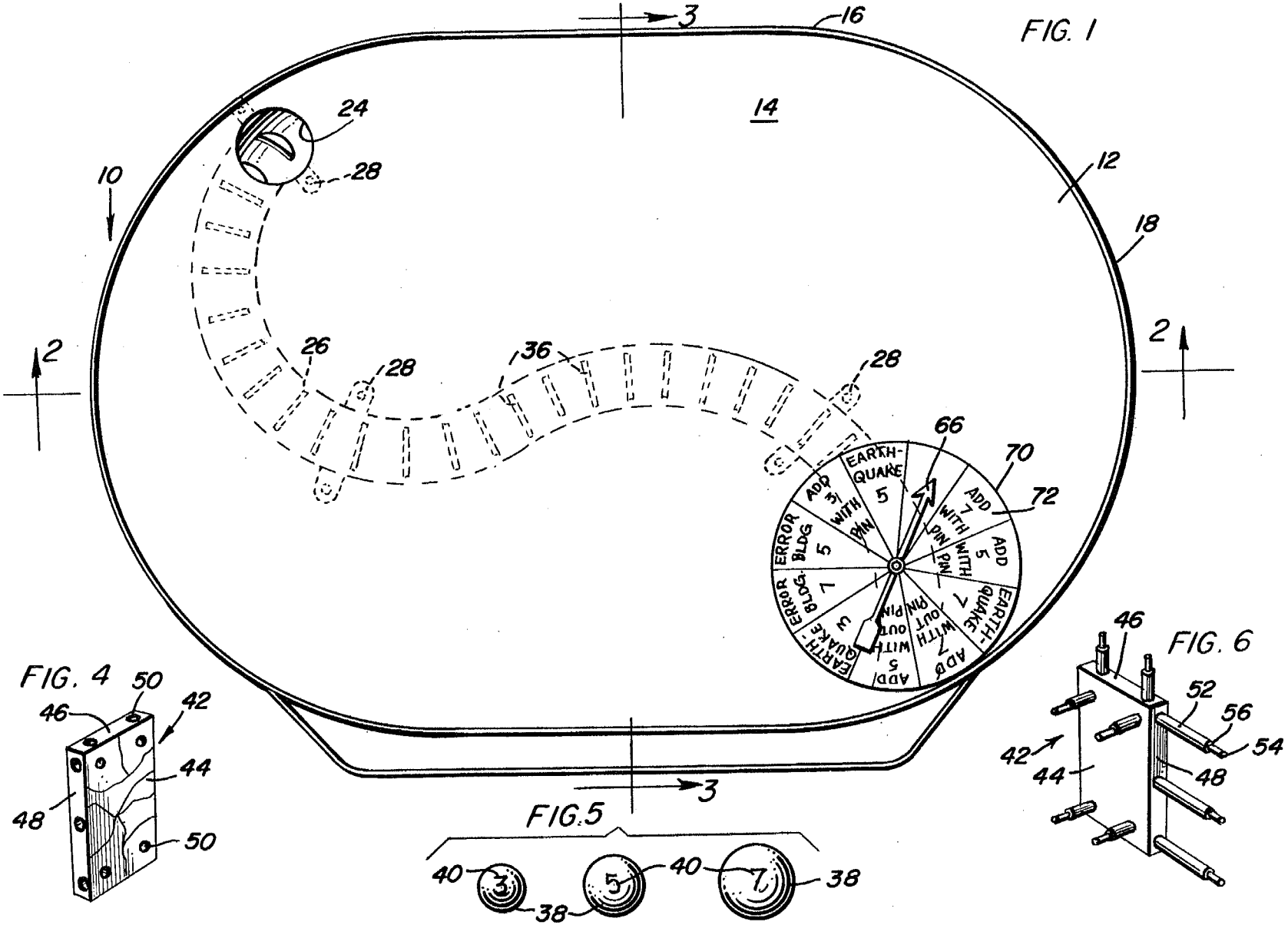
FIG. 1 is a plan view of the game device of the present invention.
FIG. 4 is a perspective view of one of the building blocks illustrating the holes therein.
FIG. 5 is a group view of the balls with indicia.
FIG. 6 is a perspective view of one of the building blocks illustrating the connecting pins with shoulders.

Referring now specifically to the drawings, the game device of the present invention is generally designated by numeral 10 and includes a building board 12 having a substantially planar upper surface 14 and provided with generally parallel side edges 16 and rounded end edges 18. The periphery of the building board 12 is provided with a depending skirt 20 which terminates in a lower edge for supporting engagement with a supporting surface 22 which may be a table top, floor or other supporting surface. The building board 12 may be constructed of wood, laminated wood panelling, metal, plastic, or other materials having some degree of flexibility, but being primarily rigid. The supporting structure may be in the form of a skirt 20 as illustrated or supporting legs or other supporting structure in order to support the building board 12 in elevated position above a supporting surface 22.

Adjacent one end of the building board 12 and offset toward one side edge thereof, the building board 12 includes an opening 24 having a tubular member or tunnel 26 communicated therewith and supported therefrom by use of brackets 28 attached to or encircling the member 26 and secured to the undersurface of the building board 12 in any suitable manner, such as by using fasteners 30, with the tubular member 26 having a terminal end in alignment with and in communication with the opening 24. The flanges on the brackets 28 may be variably offset in order to support the member 26 in a downwardly inclined and curved relationship from its upper end where it communicates with the hole 24 to its lower end where it communicates with a hole 32 in the lower end of the skirt 20 at the diagonally opposite corner of the game device as illustrated in FIG. 1.

A retaining tray 34 is attached to the side edge of the skirt 20 along the supporting surface 22 with the opening 32 being in communication therewith and discharging balls into the tray 34 which roll down the tubular member or tunnel 26 extending from the horizontally disposed opening 24 to the vertically disposed opening 32 with the tube or tunnel being appropriately curved and appropriately sloped so that heavy steel balls dropped into the opening 24 will roll down the interior of the tube 26 into the tray 34 at which point they will be accessible to the players. The bottom interior of the tube 26 includes a plurality of ridges 36 thereon over which heavy steel balls roll. These ridges 36 cause the ball to jump or bounce thus creating noise and also causing the tube and the building board 12 to which it is attached to vibrate or shake. The tube 26 may be constructed of plastic material with the ridges 36 integral therewith or it may be constructed of other material, including metal. As illustrated in FIG. 5, the steel balls 38 which are dropped into the hole 24 and rolled down the tube 26 may be of different size and different weight with numerical indicia 40 thereon indicating, by simulation, the severity of the earthquake with the numerals 40 indicating the reading on a Richter scale.

FIG. 4 illustrates one of a plurality of building blocks which are generally designated by numeral 42 and include planar surfaces 44 and parallel opposed end and side surfaces 46 and 48, with the side edge surfaces 46 and 48 being relatively narrow as compared to the flat opposed substantially planar surfaces 44 with all adjacent surfaces and edges being perpendicular to each other thus forming a generally parallelopiped block. As illustrated in FIG. 4, the surfaces 44, 46 and 48 have passageways 50 in the form of cylindrical bores extending completely through the block in perpendicular relation to the surface with which the passgeway communicates.

Figure 2:
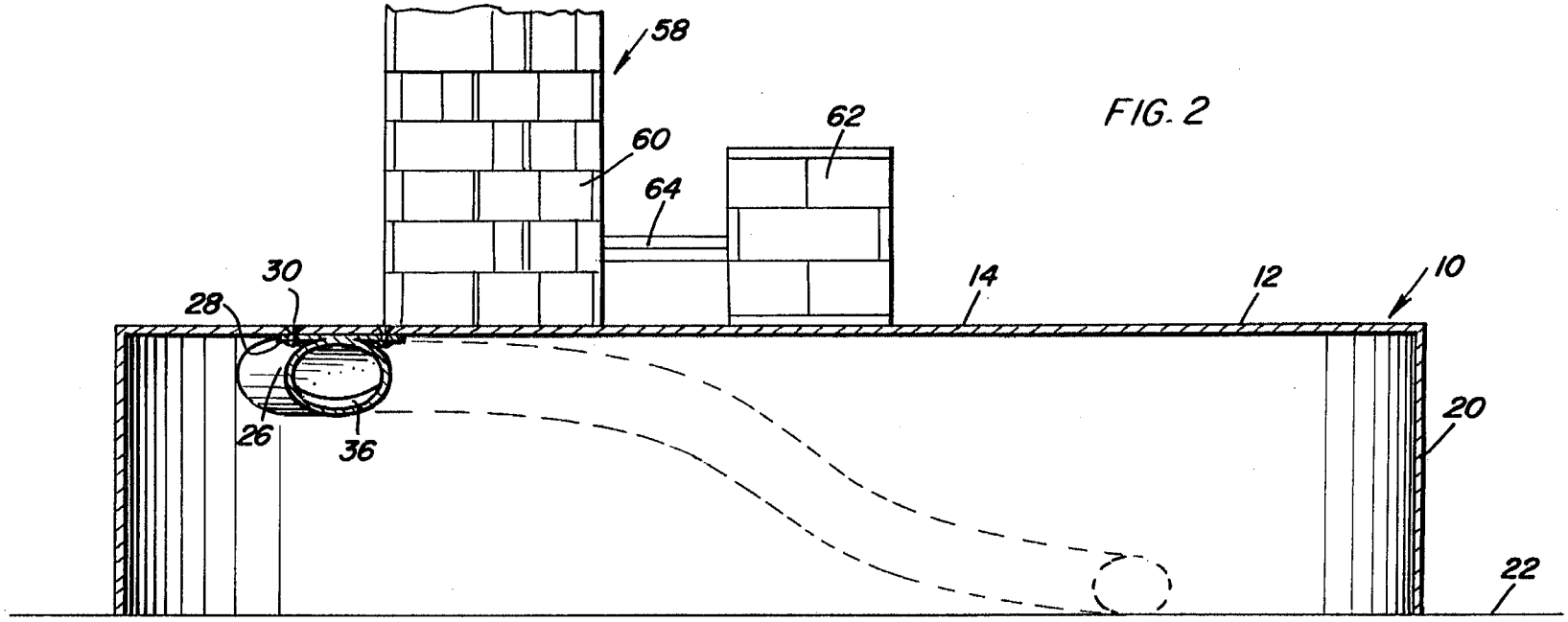
FIG. 2 is a longitudinal, sectional view taken substantially upon a plane passing along section line 2—2 of FIG. 1 illustrating further structural details of the game device.
Figure 7:
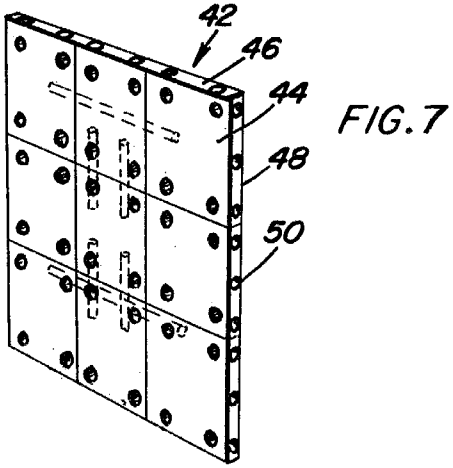
FIG. 7 is a perspective view of a series of building blocks connected together.
Figure 3:
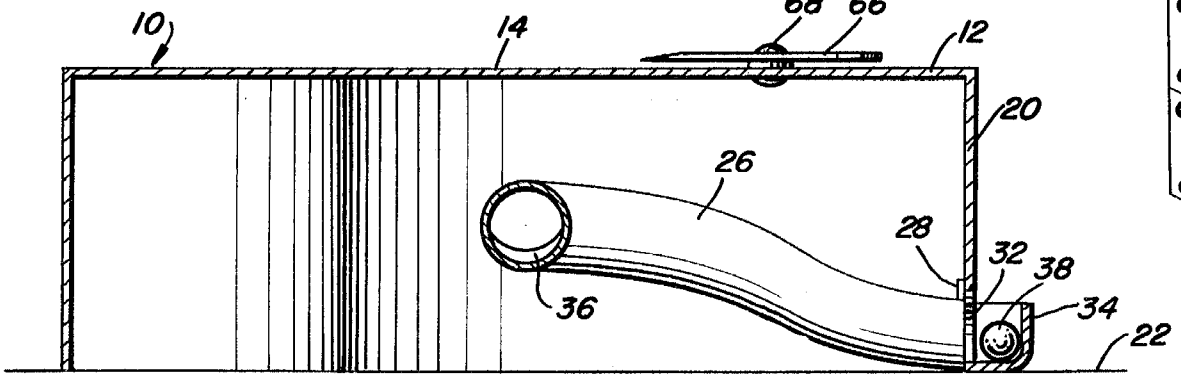
FIG. 3 is a transverse, sectional view taken substantially upon a plane passing along section line 3—3 of FIG. 1 illustrating further structural details of the device.

For interconnecting the block, a plurality of pins 52 are provided which may be of constant diameter as shown in FIG. 7 or have reduced end portions 54 to define a shoulder 56 as shown in FIG. 6. These pins are slightly smaller in diameter than the passageways and can be inserted therein, either extending all the way through or partially into the passageways in order to assemble a plurality of blocks 42 in assembled adjacent relation as shown in FIG. 7 to construct a building generally designated by reference numeral 58 in FIG. 2 which may include a simulated high-rise portion 60, a lower portion 62 and a connecting breezeway roof portion 64, or the like, typical of various types of office buildings, apartments, and the like. The simulated buildings are constructed on the building board 12 with the blocks 42 being assembled in a manner to form the buildings on the planar surface 14.

A spinner arrow 66 is mounted on the building board 12 by a pivot pin, screw, bolt, or the like, 68 which can be removed when desired. Underlying the spinner 66 is a circular area 70 having a plurality of segments delineated therein with indicia 72 in each of the segments to provide information and instructions for playing a game. Also, the surfaces 44 of the blocks 42 are provided with picture segments thereon as illustrated in FIG. 4 with the picture segments being on opposite faces of the building blocks to provide two picture puzzles when the building blocks are assembled in a particular manner.

The object of the game device is to build a building 58 out of the blocks 42 which may be constructed of wood, or other materials, with the blocks being generally rectangular in shape and somewhat similar to the blocks used in dominos with the holes or passageways extending therethrough as illustrated in FIG. 4 and being provided with a segment of a pictorial puzzle on the opposite planar surfaces 44. The blocks are optionally interconnected by pins as determined by the spinner which can be provided in many different lengths with the diameter of the pins being slightly smaller than the size of the passageways or the pins can be provided with larger diameters with reduced end shoulders to enable the blocks to be supported in spaced apart relation to each other when a pin having reduced ends has the reduced ends received in aligned passageways in spaced apart blocks and the blocks engaging the shoulder 56 of the pin.

The earthquake simulating device may be a tube or a channel-shaped rigid tunnel that has a generally S-curved configuration under the building board 12 with the height of the building board above the supporting surface being approximately four inches and the fall of the tunnel being approximately four inches. The three balls 38 may be constructed of steel, or the like, with the balls being of different size and weight and provided with indicia designating the severity of an earthquake on the Rickter scale. As the balls are dropped into the opening 24, they will roll over the ridges and jump or bounce to cause a vibration or noise to simulate earthquake conditions. Any suitable flanges, mounting pads or brackets may be utilized to secure the tube or tunnel track 36 to the underside of the building board so that the noise and vibration will be transmitted to the building board.

Each game device will have two picture puzzles with one puzzle on each side of the blocks. While the segment of the picture puzzle may vary, it is suggested that one of the picture puzzles include an illustration of the earth showing a portion thereof partially falling off or a large building or bridge could be illustrated in a partially fallen or collapsed condition. Various instructional indicia may be provided so that players taking turns spinning the spinner will assemble building blocks in accordance with the instructions, add or remove building blocks or when the arrow on the spinner indicates an earthquake, the number in the segment of the indicia underlying the spinner will indicate the size of the steel ball to be dropped into the opening 24. The steel balls will normally be stored in the tray 34 and when the spinner indicates an earthquake, the steel ball with the appropriate numeral indicating the Rictor scale number will be selected and dropped into the earthquake producing tunnel 26 with the rolling movement of the steel ball over the ridges causing the ball to jump, bounce, and the like, thereby creating noise and vibration simulative of an actual earthquake.

With this game device, three games can be played including two picture puzzle games and the earthquake game by building a structure of ones own design which will hopefully be earthquake-proof, with it being noted that whether the structure will or will not be earthquake-proof is not predetermined since the design of the buildings selected by the players will actual determine whether the building structure will be earthquake-proof or not. This device produces a noise and shaking of the structure when one of the heavy balls rolls down the tunnel and over the ridges. This game will demonstrate to players who have never experienced an earthquake, a simulation of the forces involved and acquaint players with scientific terms and measurements associated with earthquakes as well as develop hand and eye coordination and acquaint them with efforts of humanity to accommodate natural elements of the earth.

Also, the earthquake simulating device can be used in a mountain-shaped structure to simulate a volcano. The heavy metal ball rolling down the tunnel, which has been fastened to the inside of the mountain, can switch lights on and off, trip avalanches, cause mountain climbers to fall, produce loud noises, thus creating new and different games.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A game device comprising a building board forming an enlarged generally planar surface, means supporting the building board in elevated position from a supporting surface, a plurality of building blocks positionable on the upper surface of the building board to construct a block building, and an elongated, downwardly inclined trackway having the upper end connected to the building board and communicating with the upper surface of the building board through an opening and the other end oriented at a lower elevation in communication with a storage tray, at least one heavy ball rollable down the trackway by dropping it through the opening into the upper end thereof, and projections on the interior of the trackway engageable by the ball to produce noises and vibrations as the ball rolls down the trackway, simulative of earthquake conditions for producing noise and vibration of the building board to determine if the arrangement of building blocks on the building board will withstand the vibrations simulative of an earthquake.

2. A game device comprising a building board, means supporting the building board in elevated position from a supporting surface, a plurality of building blocks positionable on the upper surface of the building board to construct a block building, and means attached to said building board simulative of earthquake conditions for producing noise and vibration of the building board to determine if the arrangement of buildings blocks on the building board will withstand the vibrations simulative of an earthquake, said means simulative of an earthquake including an elongated, downwardly inclined tunnel structure having one end communicating with the upper surface of the building board and the other end oriented at a lower elevation to communication with a storage tray, at least one heavy metal ball rollable down the tunnel structure by dropping it into the end thereof communicating with the upper surface of the building board, and projections on the interior of the tunnel structure engageable by the ball to produce noises and vibrations as the ball rolls down the tunnel structure, and additional balls of different weight and numerical indicia on said balls simulative of the Richter scale to enable simulative earthquakes of different severity to be produced.

3. The structure as defined in claim 2 wherein said projections on the tunnel structure are in the form of transversely extending ridges along the bottom surface of the tunnel structure, said tunnel structure including a tubular member supported from the undersurface of the building board.

4. The structure as defined in claim 2 wherein said blocks have segments of picture puzzles on opposite surfaces thereof to enable picture puzzle games to be played.

5. A game device comprising a building board, means supporting the building board in elevated position from a supporting surface, a plurality of building blocks positionable on the upper surface of the building board to construct a block building, and means attached to said building board simulative of earthquake conditions for producing noise and vibration of the building board to determine if the arrangement of building blocks on the building board will withstand the vibrations simulative of an earthquake, said means simulative of an earthquake including an elongated, downwardly inclined tunnel structure having one end communicating with the upper surface of the building board and the other end oriented at a lower elevation in communication with a storage tray, at least one heavy metal ball rollable down the tunnel structure by dropping it into the end thereof communicating with the upper surface of the building board, and projections on the interior of the tunnel structure engageable by the ball to produce noises and vibrations as the ball rolls down the tunnel structure, said projections on the tunnel structure being in the form of transversely extending ridges along the bottom surface of the tunnel structure, said tunnel structure including a tubular member supported from the underside of the building board, and a spinner mounted on said building board, indicia underlying said spinner to indicate assembly and disassembly of building blocks and to drop a ball into the upper end of the tunnel structure.

6. The structure as defined in claim 5 wherein said building blocks have through passageways, and connecting pins received in said passageways to stabilize the building to render it more or less earthquake-proof.

* * * * *